US008857569B2

(12) United States Patent
Friedli

(10) Patent No.: US 8,857,569 B2
(45) Date of Patent: Oct. 14, 2014

(54) ELEVATOR ACCESS CONTROL SYSTEM

(75) Inventor: Paul Friedli, Remetschwil (CH)

(73) Assignee: Inventio AG, Hergiswil NW (CH)

( * ) Notice: Subject to any disclaimer, the term of this patent is extended or adjusted under 35 U.S.C. 154(b) by 660 days.

(21) Appl. No.: 13/171,562

(22) Filed: Jun. 29, 2011

(65) Prior Publication Data

US 2012/0160613 A1 Jun. 28, 2012

(30) Foreign Application Priority Data

Jun. 30, 2010 (EP) ..... 10167984

(51) Int. Cl.
*B66B 1/20* (2006.01)
*B66B 5/00* (2006.01)

(52) U.S. Cl.
CPC ..... *B66B 5/0012* (2013.01)
USPC ..... 187/384; 187/392

(58) Field of Classification Search
CPC ..... B66B 1/24; B66B 5/02; B66B 13/14
USPC ..... 187/247, 380–388, 391–396
See application file for complete search history.

(56) References Cited

U.S. PATENT DOCUMENTS 4,847,485 A 7/1989 Koelsch
6,707,374 B1 * 3/2004 Zaharia ..... 340/5.31
7,140,469 B2 * 11/2006 Deplazes et al. ..... 187/316
7,190,256 B2 * 3/2007 Pieper ..... 340/5.7
7,581,622 B2 * 9/2009 Amano ..... 187/384
7,882,938 B2 * 2/2011 Blackaby et al. ..... 187/388
8,020,672 B2 * 9/2011 Lin et al. ..... 187/392
8,061,485 B2 * 11/2011 Finschi ..... 187/384
8,381,880 B2 * 2/2013 Finschi ..... 187/388
8,464,840 B2 * 6/2013 Flynn et al. ..... 187/384
8,490,754 B2 * 7/2013 Amano ..... 187/384
2004/0188185 A1 9/2004 Pieper

FOREIGN PATENT DOCUMENTS

JP 2008230805 10/2008
WO 2010002378 1/2010

* cited by examiner

*Primary Examiner* — Anthony Salata
(74) *Attorney, Agent, or Firm* — Stroock & Stroock & Lavan LLP

(57) ABSTRACT

An elevator access control system monitors a secure area, including an elevator landing, and controls an elevator system with at least one elevator car that is accessible from the elevator landing. Each elevator car of the elevator system has a door at the landing that provides access between the elevator car and the landing. The system includes an access monitoring device that detects the presence of non-authorized individuals within the secure area and produces a breach signal upon detecting one or more non-authorized individuals within or entering the secure area. Upon receiving the breach signal, an access system controller in communication with the access monitoring device initiates a security alert phase.

23 Claims, 5 Drawing Sheets

ELEVATOR ACCESS CONTROL SYSTEM

CROSS-REFERENCE TO RELATED APPLICATION

This application claims priority to European Patent Application No. 10167984.3, filed Jun. 30, 2010, which is incorporated herein by reference.

FIELD

The disclosure relates to access control systems, and particularly relates to an access control system that controls passageways into and out of a secure area.

BACKGROUND

Most buildings require some level of access control to prevent parts of the building from being accessible to the public. In many buildings this access control is included at the entrance to the building itself. However, many larger buildings have portions of the building that are accessible to the public, while other parts are private and require a certain level of security. It is particularly common for the ground floor or lobby of a large building to be open to the public, but access to the upper floors of the building to be private and secured. To limit access or keep the upper floors of the building secure, many buildings of this type entirely restrict non-authorized individuals from accessing the elevators. To ensure that non-authorized individuals are unable to access the elevator, the building may have barriers or security officers, or a combination of each. Neither of these solutions is ideal.

Often times tenants of buildings find the use of restrictive barriers to be unsightly. Moreover, depending on the type used, the barriers may hinder foot traffic into and out of the building. To limit the problems associated with restrictive barriers, they are typically kept as small as possible. However, small barriers, for example short turnstiles, are not particularly effective at keeping access to an area restricted. A person determined to enter the restricted area may, for example, jump over the turnstiles or circumvent the barrier in another manner. Accordingly, such barriers typically are coupled with security officers.

However, a team of security officers, though effective, can be expensive to maintain. Thus, there is a need for an access control system that limits access to the certain floors of a building without requiring restrictive barriers or a large number of security officers.

International Patent Application Publication No. WO 2010/002378 A1 discloses a security-based elevator control method that operates elevator cars based in part on the determination of a security violation involving one of the elevator cars. The disclosed method uses sensors that detect the presence of an unauthorized user as the user enters the elevator car by crossing a threshold between the landing and the car. A sensor is placed at each elevator car opening. This method requires that the unauthorized person be wearing a detectable identification tag that can be identified by the sensor, such as the identification tag on an infant or medical patient, or a tracking device on an incarcerated individual. Alternatively, an authorized individual, such as a receptionist, may note the presence of an unauthorized user within an elevator car and notify the security-based system. Although a system of this type may be effective at containing known unauthorized persons that are tagged with identification or tracking devices, it is not capable of preventing unknown unauthorized persons from using the elevator system.

SUMMARY

Embodiments of the disclosed technologies utilize controlled passageways that are already available, such as elevators, in cooperation with an access monitoring device to restrict areas of a building from being accessed by non-authorized individuals. In an embodiment, the technologies provide an access control system that includes a secure area providing access to one or more controlled passageways. An access monitoring device is used to detect the presence of non-authorized individuals within the secure area and to produce a breach signal upon a detection of non-authorized individuals within the secure area. An access system controller in communication with the access monitoring device initiates a security alert phase upon receiving the breach signal. A controller is then alerted to prevent the non-authorized individuals from leaving the secure area using the one or more controlled passageways.

In another embodiment, an access control system monitors a secure area including an elevator landing and controls an elevator system having at least one elevator car that is accessible from the elevator landing. Each elevator car of the elevator system has a door at the landing that provides access between the elevator car and the landing. The access control system includes an access monitoring device that detects the presence of non-authorized individuals within the secure area and produces a breach signal upon detecting the non-authorized individual. Upon receiving the breach signal, a security system controller in communication with the security detector initiates a security alert phase. The access control system includes an elevator system controller that monitors each elevator car during the security alert phase to identify elevator cars with doors at the landing that have an open door status. For each elevator car with an open door status during the security alert phase, the system prevents user operation of the elevator car and holds the respective doors open for a remainder of the security alert phase.

Further embodiments provide a method of securing an elevator system that includes defining a secure area including an elevator landing providing access to an elevator system including at least one elevator car, monitoring the presence or entry of unauthorized individuals in the secure area, initiating a security alert phase upon detecting the presence or entry of unauthorized individuals in the secure area, monitoring a status of each elevator car in the elevator system during the security alert phase to identify each elevator car having a respective door at the landing with an open door status, preventing user operation of each respective elevator car with a corresponding door having an open door status at the elevator landing and holding the respective door at the landing open for a remainder of the security alert phase.

BRIEF DESCRIPTION OF THE DRAWINGS

Exemplary embodiments of the disclosed technologies are described in more detail below with reference to the drawings, in which.

DETAILED DESCRIPTION

Figure 1:
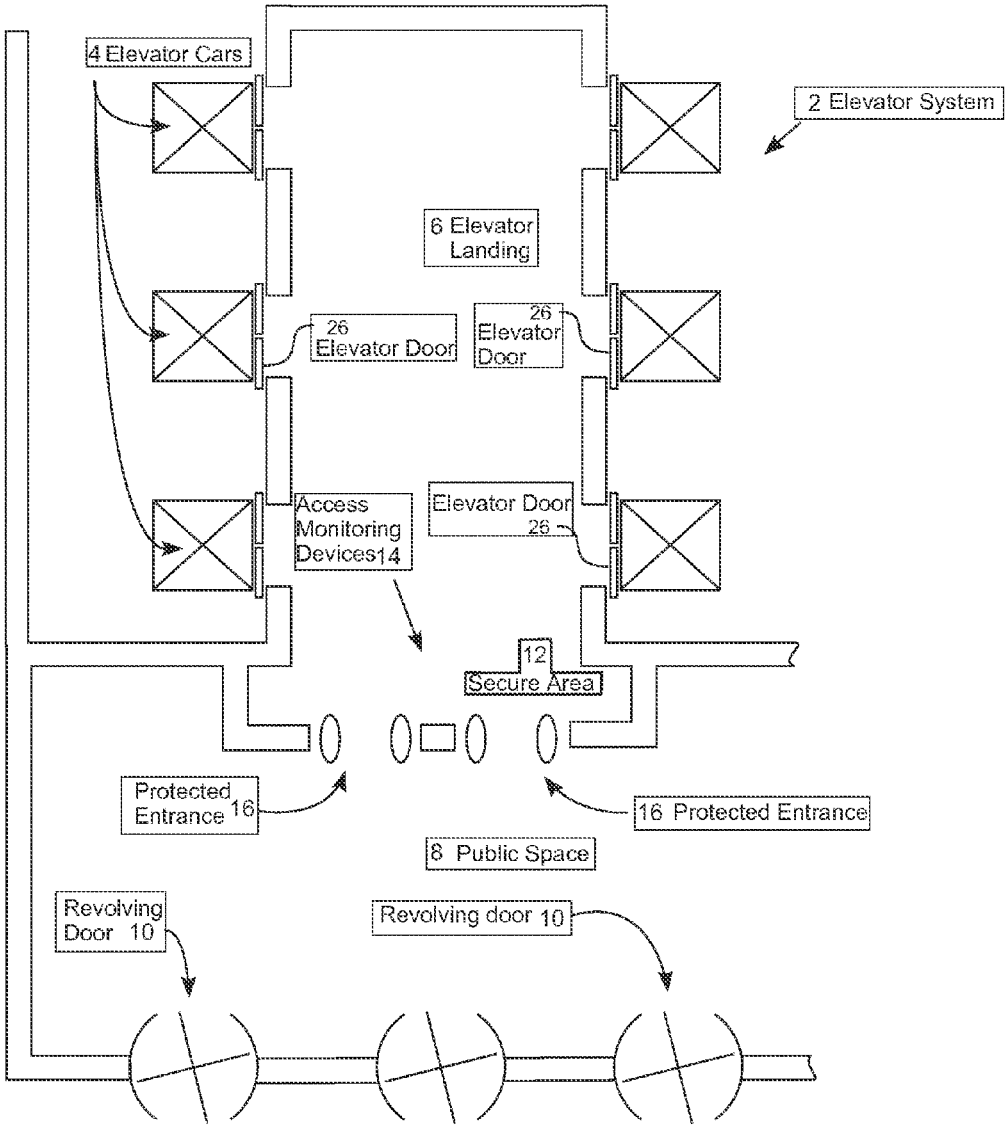
FIG. 1 is a floor plan view of an area secured by an exemplary access control system.

FIG. 1 shows a floor plan of an area providing access to a secure elevator system 2. The illustrated elevator system 2 includes six elevators 4 that are accessible from and provide access to a common elevator landing 6. As an example, the area shown in the floor plan of FIG. 1 may be a lobby of a commercial building. The building may include public space and/or retail space, and therefore, portions of the lobby are accessible to the public. For example, in the illustrated building there is public space 8 adjacent to the revolving doors 10 that provide access to the building. The upper floors of the building that are accessible by the elevator cars 4 are typically private or restricted, and therefore are only open to authorized individuals. To maintain the security of the upper floors, the elevator landing 6 is maintained within a secure area 12 that is only accessible by authorized individuals. The term individual, as used herein, includes people and may also include animals, robots and other mobile machinery. Accordingly, the elevator system 2 can secure other floors that are accessible with the elevators from unauthorized people or other threats that are attempting to access the rest of the building using the elevator system 2.

Access to the secure area 12 is screened for unauthorized individuals by an access monitoring device 14. In the embodiment shown in FIG. 1, the access monitoring device 14 includes two protected entrances 16, configured to detect the passing of authorized and unauthorized individuals therethrough. Aside from the elevator cars 4 of the elevator system 2, the protected entrances 16 provide the only other access to the secure area 12. Accordingly, the protected entrances 16 are able to reliably monitor the entry of unauthorized individuals into the secure area 12 from the public space 8. A specific embodiment of a protected entrance 16 using an identification card is described in more detail below. However, other types of access monitoring devices 14 may also be used in connection with the disclosed technologies. For example, the protected entrance 16 could identify individuals entering the secure area using biometric identification, such as fingerprint, retina or iris scanning. As another alternative, the access monitoring device 14 could monitor the presence of authorized individuals at any location within the secure area. Such a system could include a device, such as a camera or antenna, to locate any individuals within the secure area 12 and match the individuals with the position of corresponding identification tags, such as an RFID tags. Thus, if the camera or antenna locates a person within the secure area 12 that does not have a corresponding RFID tag, the access monitoring device would identify the person as being unauthorized. Alternatively, the access monitoring device could monitor the entire secure area 12 using biometric data that is recognizable from a distance, such as facial recognition.

The elevator access control system prevents unauthorized individuals from accessing other floors of the building by limiting access to the other floors through controlled passageways connecting the secure area 12 with the other floors. In the embodiment shown in FIG. 1, all of the controlled passageways are elevator cars 4. As discussed in greater detail below, in this embodiment, when the access monitoring device 14 detects that the secure area has been breached by one or more unauthorized individuals, a security alert phase is established and any elevator cars 4 at the landing 6 are prevented from leaving the landing 6 until the breach has been addressed and the security alert phase is ended. However, the access control system of the disclosed technologies may also be used with other passageways providing access between the secure area 12 and other floors. For example, in the embodiment shown in FIG. 2, a doorway 18 provides a passageway from the secure area 12 to a stairwell 20 leading to other floors. In addition to preventing user operation of the elevator cars 4 during a security alert phase, the access control system may also lock the doorway 18 during the security alert phase to prevent unauthorized individuals from accessing the private floors of the building using the stairway 20.

At least some embodiments allow the security of a building to be maintained without requiring constant monitoring of the secure area 12 by one or more security officers. Moreover, because security officers are not needed at each of the entryways to the secure area 12, the secure area 12 can be accessible from a large number of entryways without requiring a large number of security officers. To maintain the security of the area, the access control system can monitor the entire area, using cameras, for example, as described above, or each entryway can be provided with one or more corresponding protected entrances 16. Accordingly, a large building can be kept secure with a much smaller team of security officers. The access control system can also be used with multiple secure areas 12. For example, the access control system could be used with a large building that is occupied by two different tenants and four elevator banks. If three of the elevator banks are used by one tenant and the fourth is used by the other tenant, a first secure area can be defined that includes the elevator landings 6 corresponding to the first three elevator banks and a second security area can be defined that includes the elevator landing 6 corresponding to the fourth elevator bank. The two secure areas 12 can then be treated separately by the security system, and security officers can address security breaches individually in the secure areas in which they occur. On the other hand, the access control system could also be used with a small building having only one elevator. The access control system would allow the security of the small building to be maintained and any security breaches to be addressed by security officers that are located remotely from the building.

Figure 3:
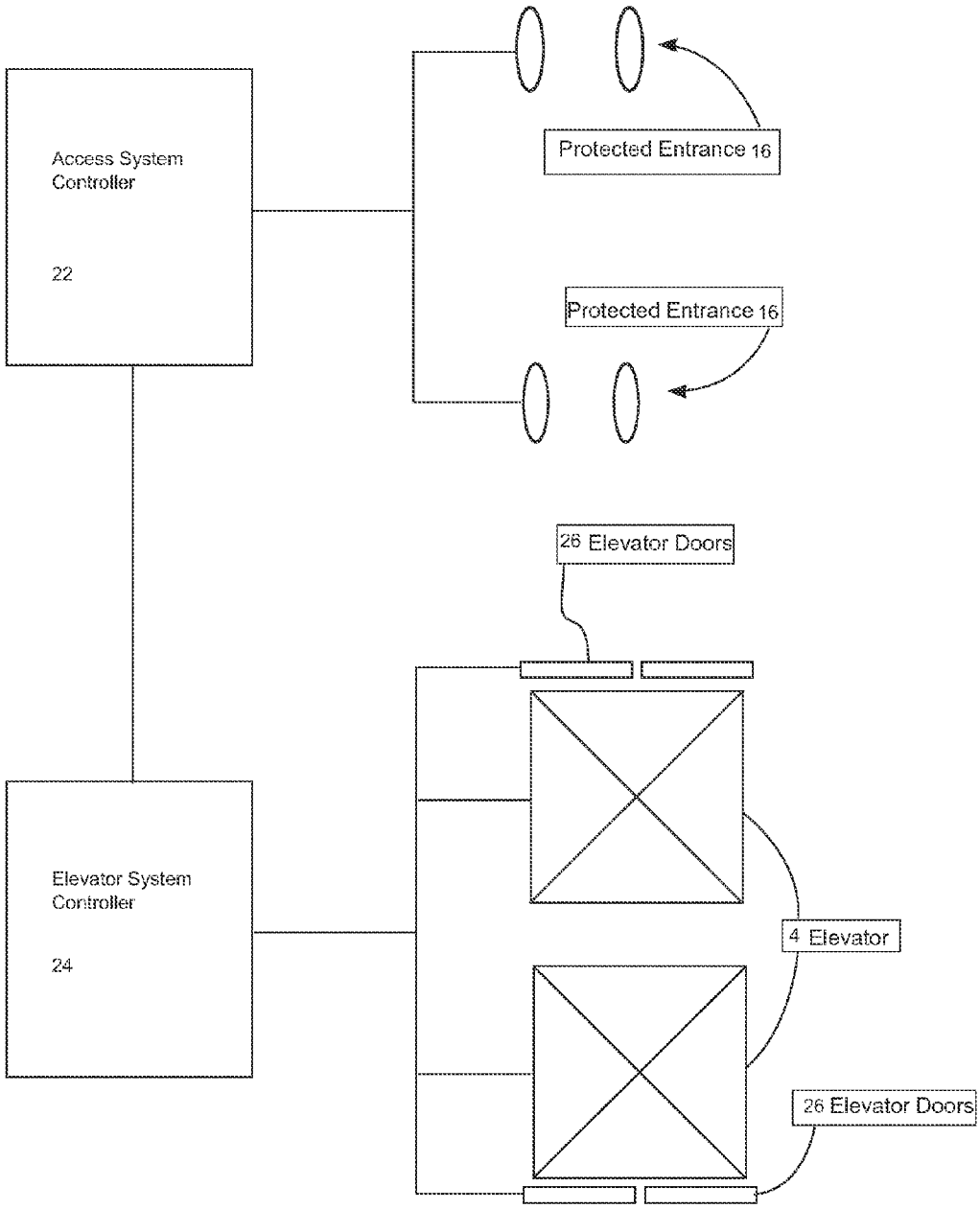
FIG. 3 illustrates a communication network used with an access control system.

The access control system of at least some embodiments combines the control of the elevator system 2 with an access controller, as illustrated in FIG. 3, to allow only authorized individuals onto private floors of the building through the elevators or other passageways. The system includes an elevator system controller 24 that communicates with the elevator cars 4 and the elevator doors 26 to control the functions of the elevators. For example, the elevator system controller 24 could be a single dispatching computer that operates the functions of all of the elevators in the entire building, or could be a combination of one or more microprocessors corresponding to each elevator that are in communication. During standard operation, when there is no improper access or no security threat, the elevator system controller 24 operates the elevator cars 4 and elevator doors 26 normally, allowing the operation of the elevators to be governed by the actions of authorized individuals, for example by calling the elevator to certain floors using buttons. At the same time, the security of the elevator system 2 is monitored by an access system controller 22, which communicates with one or more protected entrances 16. For example, the access system controller 22 could be a security computer that is in communication with each of the protected entrances 16 and also in communication with the elevator system controller 24. Alternatively, the access system controller 22 could be formed by a plurality of microprocessors corresponding to each protected entrance 16 that are each in communication with the elevator system controller 24. As another alternative, the access system controller 22 and the elevator system controller 24 may be implemented in a single processing unit that communicates with each of the protected entrances 16 and each of the elevator cars 4.

If there is no breach of access or security, the access system controller 22 allows the elevator system controller 24 to operate normally. However, if one or more of the protected entrances 16 indicates the entry of non-authorized individuals to the secure area 12, the protected entrance 16 will issue a breach signal to the access system controller 22. In response to receiving the breach signal, the access system controller 22 initiates a security alert phase, and communicates the initiation of the security alert phase to the elevator system controller 24. Once the elevator system controller 24 receives a communication indicating that a security alert phase has begun, the elevator system controller 24 operates the elevator cars 4 and doors 26 in a protected mode to prevent entry of non-authorized individuals to other floors of the building.

The protected mode of operation enacted by the elevator system controller 24 can range from a strict shut-down of all elevator functions in the elevator system, to a more complex protected mode, in which user operation of the elevators is limited but the elevators remain functional. In one embodiment of the protected mode of operation, wherein all elevator functions are shut down, the elevator system controller 24 prevents unauthorized individuals from gaining access to other floors of the building through the secure area 12 by stopping all elevator movement. In another embodiment, the elevator system controller 24 can use more complex modes of operation to contain the unauthorized individual while at the same time maintaining some operation of the elevator system. For example, the elevator system controller 24 may control the elevators during a security alert phase to operate normally on all other floors but to be restricted on the floor with the secure area 12 where the security breach has occurred. For instance, any elevator that is located at the unsecure floor at the time of the security breach may have its functions shut down, while elevators located on other floors at the time of the security breach may operate freely amongst all other floors served by the elevators. Alternatively, the elevators located at the unsecure floor may remain functional, but user operation of the elevator can be prevented. For example, the elevator system controller 24 may continue to operate the elevator but ignore user input for the elevator, such as a user pressing a button within the elevator. To maintain even more functions of the elevators, any elevator that is located away from the unsecure floor at the time of the security breach can be allowed to travel to the unsecure floor, but be prevented from subsequently leaving the unsecure floor until the security alert phase has ended. This allows passengers to travel to the unsecure floor normally, and only prevents unauthorized individuals from accessing other floors from the breached secure area 12.

In a particular embodiment, the operation of the elevator cars 4 and doors 26 during a security alert phase may be controlled to both prevent unauthorized individuals from accessing other floors served by the elevators and to assist security officers in locating the unauthorized individual. In this particular embodiment, any elevator that is located at the landing 6 corresponding to the floor with the secure area 12 and has its doors open or partially open at the time of the security breach will be held at that floor with its doors open for the remainder of the security alert phase. Moreover, any elevator car 4 that arrives at the floor with the breached secure area 12 during the security alert phase will be held at that floor with its doors open. Accordingly, when security officers arrive to handle the security breach, all of the elevator cars 4 that had an open door state at the landing 6 of the breached secure area 12 at any time during the security alert phase will have their doors 26 open. Accordingly, the unauthorized individual will be unable to hide within an elevator car 4. Once the security officers have located the unauthorized individual, or dealt with the access or security breach in another manner, the access system controller 22 can be instructed to end the security alert phase. Subsequently, the access system controller 22 can send a signal to the elevator system controller 24 indicating that the security alert phase has ended and allowing the elevator system controller 24 to operate, once again, in a normal operating mode.

Figure 2:
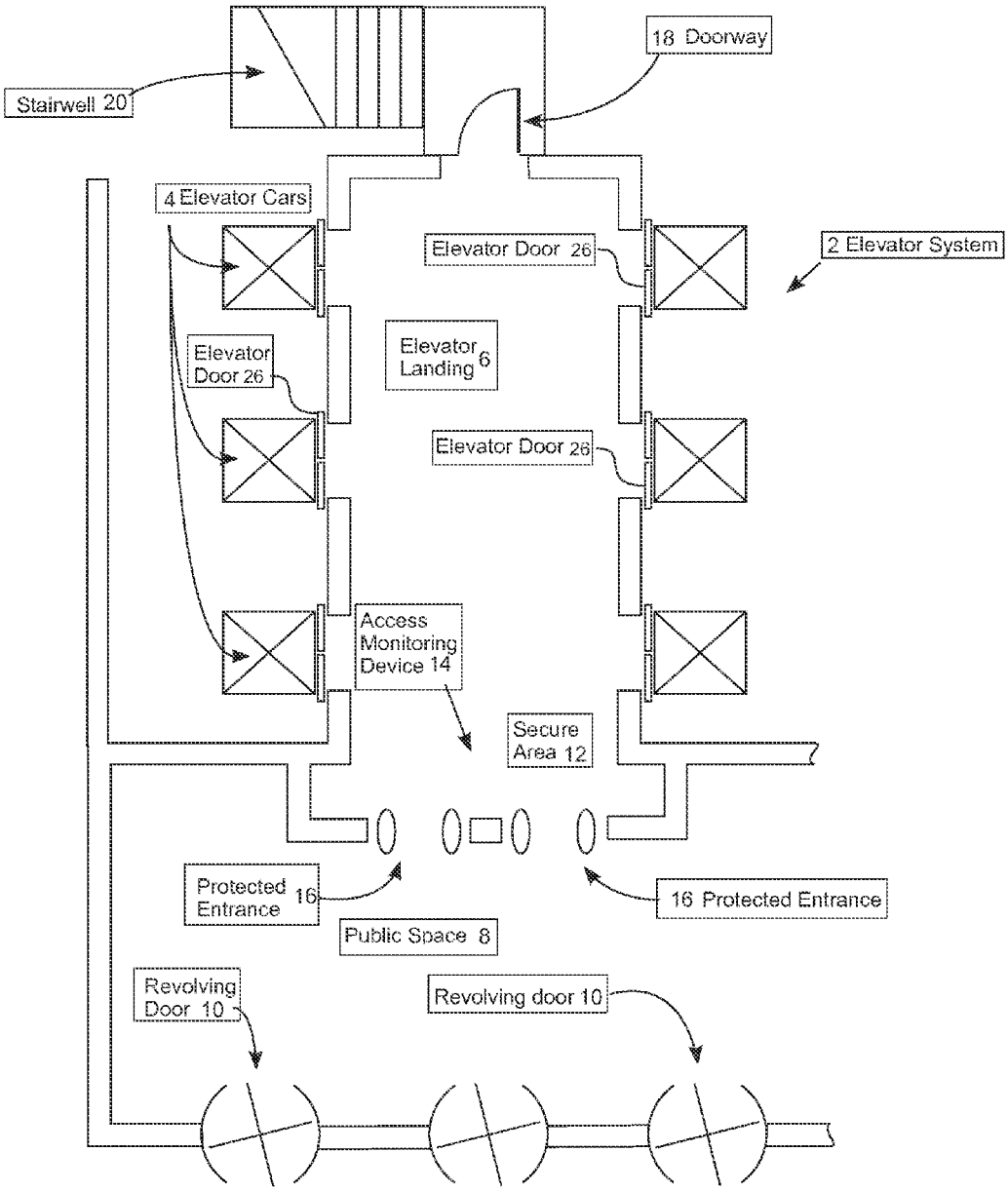
FIG. 2 is a floor plan view of an area secured by an exemplary access control system.

In the embodiments shown in FIGS. 1 and 2, the access monitoring device 14 includes several protected entrances 16 providing access from the public space 8 to the secure area 12. In this embodiment, the protected entrances 16 represent the only access points to the secure area 12 aside from the controlled passageways, which include the elevator cars 4 and doorway 18.

Accordingly, any individual who wishes to access the secure area 12 from the public space 8 may do so only through a protected entrance 16. In one embodiment, the protected entrance 16 is configured to allow only a single person at a time to pass therethrough. For example, the protected entrance 16 may take the form of a narrow doorway that is wide enough for only a single person, or a revolving door.

Figure 4:
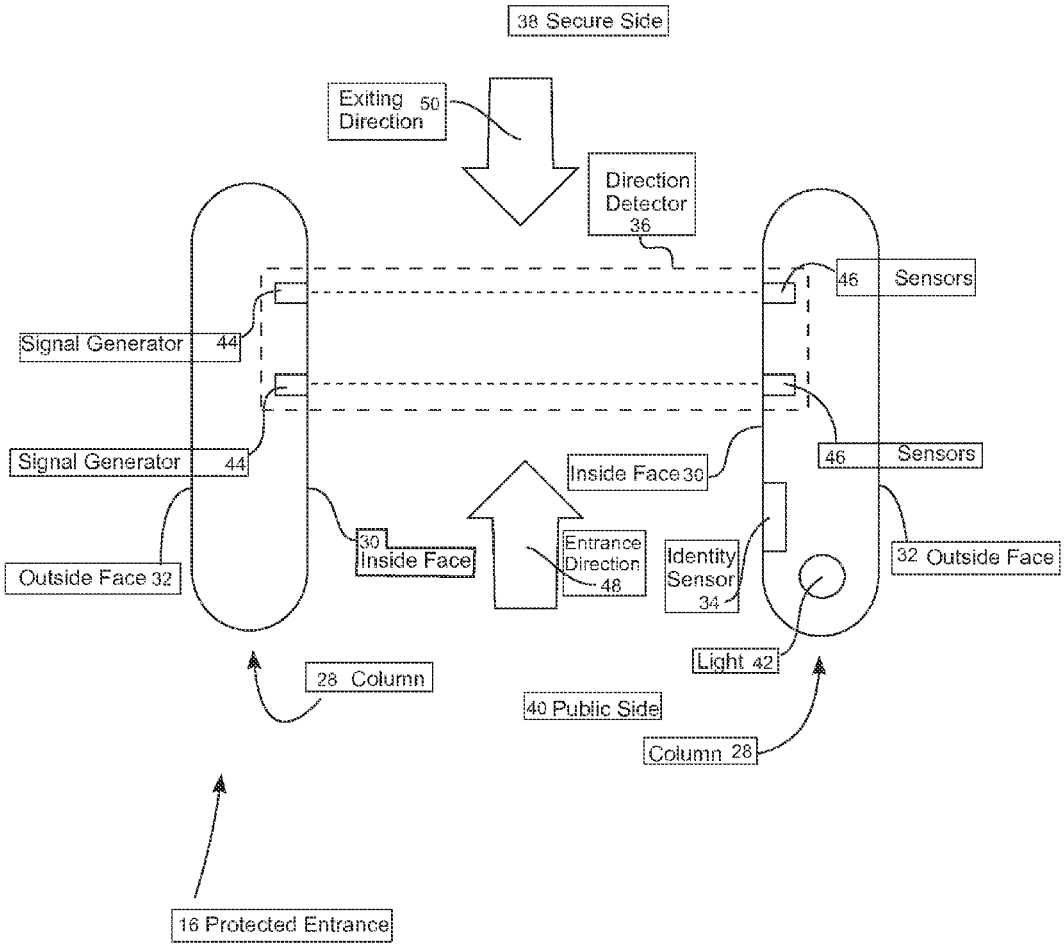
FIG. 4 shows an embodiment of a protected entrance.

FIG. 4 shows additional details of an embodiment of the protected entrance 16 which may be used in FIGS. 1 and 2. The entrance 16 includes two columns 28 that are separated at a distance to form a passageway. Each column 28 has an inside face 30 bordering the passageway and an outside face 32 facing away from the passageway. To prevent unauthorized individuals from circumventing the protected entrance, the outside face 32 of each column 28 can be disposed adjacent to a wall or other barrier. Alternatively, the outside face 32 of one protected entrance 16 may serve as the inside face 30 of an adjacent protected entrance 16; such a series of adjacent protected entrances 16 may share columns 28. The protected entrance 16 includes an authorized access detector that includes an identity sensor 34 and a direction detector 36. The identity sensor 34 is configured to read an identification tag of a person attempting to pass through the doorway of the protected entrance 16 from a public side of the entrance (region 40) to the secure side of the entrance (region 38). The direction detector 36 of the authorized access detector determines whether a person passes through the entrance and whether the person is entering or exiting the secure area 12.

The authorized access detector monitors authorized access of the secure area 12 and issues the breach signal if unauthorized entry occurs. If a person passes through the protected entrance 16 starting from the secure side 38, the authorized access detector will not issue a breach signal, because the person is leaving the secure area. On the other hand, if a person passes through the protected entrance 16 starting from the public side 40 without first presenting an authorized identification tag to the identity sensor 34, the authorized access detector will cause the protected entrance 16 to issue a breach signal to the access system controller 22. If authorized individuals wish to enter the secure area 12 from the public side 40 of the protected entrance 16, they first present an authorized identification tag to the identity sensor 34. Once the identity sensor 34 determines that the person is authorized for entry into the secure area, a signal is optionally presented to the person indicating that their entry has been approved. The person is then able to enter the secure area through the protected entrance without triggering a breach signal. For example, the protected entrance may present a signal using a light or sound that indicates that entry has been approved. The illustrated embodiment of the protected entrance includes a light 42 to demonstrate that entry has been approved.

The direction detector 36 of the embodiment shown in FIG. 4 is formed by a pair of photo-electric elements spanning the passageway between the columns 28 of the entrance 16. Each photo-electric element includes one or more signal generators 44 that projects a beam toward a sensor 46. The direction detector 36 determines that a person has passed through the entrance by monitoring when either beam is broken. If either sensor 46 fails to sense the beam, the direction detector 36 determines that a person has passed through the doorway.

The direction detector 36 is able to determine if a person is leaving or entering the secure area 12 based on the timing in which the sensors 46 detect that the beam has been broken. The photo-electric elements are positioned in a sequence from the secure side 38 of the entrance 16 to the public side 40 of the entrance. Accordingly, the direction detector 36 is able to detect the direction in which a person who walks through the entrance is traveling, based on which beam is broken first. If the beam on the secure side 38 of the entrance 16 is broken first, it may be determined that the individual passing through the entrance 16 is leaving the secure area traveling in direction 50 shown in FIG. 4. On the other hand, if the beam on the public side 40 is broken first, it may be determined that the individual is traveling in direction 48 and entering the secure area 12. This information can be used by the security system to control when a breach signal is generated by the security system controller.

The use of a protected entrance 16, as illustrated in FIG. 4, in connection with the access control system illustrated in FIG. 1 can demonstrate how the direction of individuals passing through the entrance 16 can be used for choosing whether or not to initiate a security breach phase based on the direction of individuals passing through the protected entrance. For example, the following sequence of events may occur when an authorized individual is traveling from outside the secure area to an upper floor of the building that is protected by the security system. The individual enters the building through revolving door 10 into public space 8. The individual approaches the protected entrance 16 and presents a security credential to identity sensor 34. As a result, when the individual passes through the protected entrance 16 along the entrance direction 48, the access system controller 22 does not initiate a security breach phase because the individual's entry has been authorized through use of the identity sensor 34. After passing through the protected entrance into the secure area 12, the individual may access the other floors of the building using the elevator cars 4. Thus, by presenting the proper security credential, a security breach phase is not initiated. Later, when the individual leaves the building, he or she arrives at the secure area using one of the elevator cars 4, and exits the secure area through the protected entrance 16 along exiting direction 50. The direction detector 36 is able to determine that the individual passing through protected entrance is exiting the secure area based on the sequence in which the beams from generators 44 are broken. Accordingly, the access control system can determine that the individual does not present a security threat since they are leaving the secure area, and the access control system does not initiate a security breach phase. This allows individuals to leave the secure area of the building without presenting any security credential. In addition, it allows authorized visitors of the secured floors of the building, who do not have security credentials, to exit without being escorted. However, if an unauthorized individual passes through the protected entrance 16 along entrance direction 48 but does not present a proper security credential, the access system controller 22 will initiate a security breach phase and the elevators will be prevented from allowing the unauthorized individual from accessing other floors of the building.

Figure 5:
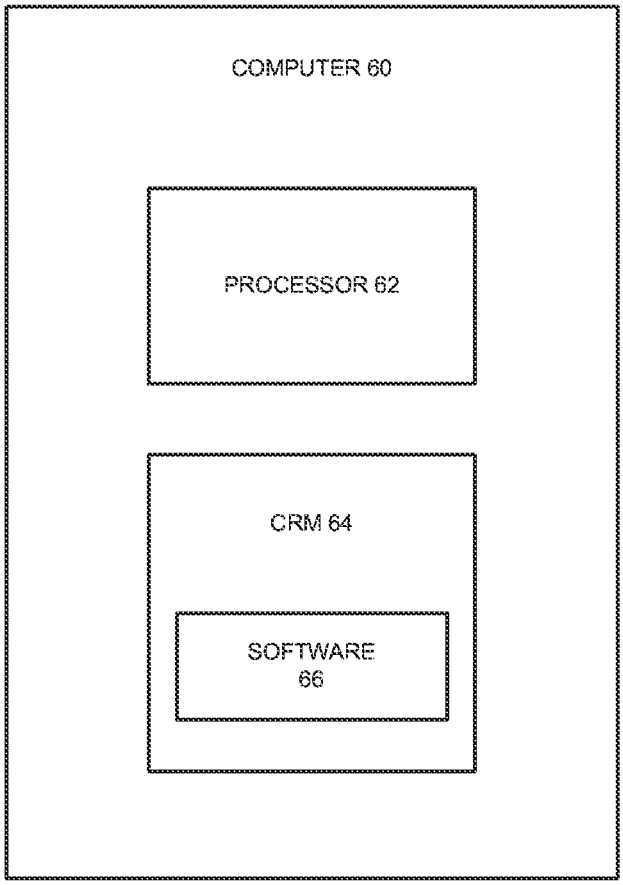
FIG. 5 shows a block diagram of an exemplary embodiment of a computer.

One or more embodiments of the disclosed methods can be performed using a computer. FIG. 5 shows a block diagram of an exemplary embodiment of a computer 60. The computer 60 comprises at least one processor 62 and at least one computer-readable storage medium (CRM) 64, which stores software instructions 66. When executed by the processor 62, the instructions 66 cause the processor 62 to perform one or more method acts disclosed herein. The CMR 64 can comprise, for example, one or more optical disks, volatile memory components (such as DRAM or SRAM), and/or nonvolatile memory components (such as hard drives, Flash RAM or ROM). The CRM 64 does not solely comprise transitory signals.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator access control system comprising:

an access monitoring device operable to detect the presence of non-authorized individuals within a secure area including an elevator landing and to produce a breach signal upon a detection of one or more non-authorized individuals within the secure area;

an access system controller in communication with the access monitoring device and configured to initiate a security alert phase upon receiving the breach signal; and an elevator system controller configured to, monitor each elevator car during the security alert phase to identify each elevator car having a respective door at the landing with an open door status, and for each elevator car with a corresponding door at the landing having or achieving an open door status during the security alert phase, allow the door at the landing to open that is at least one of: opening at the beginning of the security alert phase, closing and subsequently reopening at the beginning of the security alert phase, or arriving at the landing during the security alert phase to open, and prevent user operation of the respective elevator car and maintain the respective door at the landing open for a remainder of the security alert phase.

2. The elevator access control system of claim 1, wherein the open door status corresponds to a door at the landing that is:

open at a beginning of the security alert phase;

in a process of opening at the beginning of the security alert phase;

in a process of closing at the beginning of the security alert phase; or opened during the security alert phase.

3. The elevator access control system of claim 1, wherein the access monitoring device includes at least one protected entrance providing direct access to the secure area, each protected entrance being remote from the elevator car, and each protected entrance including an authorized access detector configured to detect unauthorized entry to the secure area through the protected entrance and to produce the breach signal if unauthorized entry is detected.

4. The elevator access control system of claim 3, wherein the protected entrance is configured to allow one person to pass therethrough at a time.

5. The elevator access control system of claim 3 wherein each authorized access detector is configured to detect a direction of an individual passing through the protected entrance, such that the access detector is capable of not generating a breach signal in the case of an individual leaving the secure area.

6. The elevator access control system of claim 3 wherein each authorized access detector includes a direction detector configured to detect a direction of an individual passing through the protected entrance, and an identity sensor configured to detect the identity of an individual entering the secure area.

7. The elevator access control system of claim 6 wherein each direction detector includes first and second sensors respectively disposed at a secure side and an unsecure side of the respective protected entrance, each sensor being operable to detect an individual passing through the protected entrance, and wherein the direction detector determines the direction of an individual passing through the protected entrance based on a detection sequence of the first and second sensors.

8. The elevator access control system of claim 7 wherein each sensor includes a beam generator and a beam detector positioned to detect a beam from the generator, the sensor being configured to detect an individual passing through the protected entrance based on a break in detection of the beam by the beam detector.

9. The elevator access control system of claim 6 wherein the authorized access detector is configured to trigger a breach signal if the direction detector detects an individual entering the secure area through the protected entrance without a previous authorized identification by the identification detector, and is configured not to trigger a breach signal if the direction detector detects an individual exiting the secure area through the protected entrance or if the identification detector detects an authorized identification before the direction detector detects an individual entering the secure area through the protected entrance.

10. The elevator access control system of claim 1, the access monitoring device comprising a card reader, the access system comprising a first computer, and the elevator system controller comprising a second computer.

11. The elevator access control system of claim 1, the access monitoring device comprising a biometric reader, the access system comprising a first processor, and the elevator system controller comprising a second processor.

12. The elevator access control system of claim 1, the access system comprising a first processing unit, and the elevator system controller comprising a second processing unit.

13. A method of securing an elevator access area, the method comprising:

defining a secure area including an elevator landing providing access to an elevator system including at least one elevator car;

monitoring the presence or entry of unauthorized individuals in the secure area;

initiating a security alert phase upon detecting the presence or entry of one or more unauthorized individuals in the secure area;

monitoring a status of each elevator car in the elevator system during the security alert phase to identify each elevator car havin a respective door at the landing with an open door status; and for each elevator car having a door at the landing that is opening at the beginning of the security alert phase, allowing the corresponding door to fully open, subsequently holding the corresponding door open for the remainder of the security alert phase and preventing user control of the corresponding elevator for the remainder of the security alert phase.

14. A method of securing an elevator access area, the method comprising:

defining a secure area including an elevator landing providing access to an elevator system including at least one elevator car;

monitoring the presence or entry of unauthorized individuals in the secure area;

initiating a security alert phase upon detecting the presence or entry of one or more unauthorized individuals in the secure area;

monitoring a status of each elevator car in the elevator system during the security alert phase to identify each elevator car having a respective door at the landing with an open door status; and for each elevator car having a door at the landing that is closing at the beginning of the security alert phase, opening the corresponding door, holding the corresponding door open for the remainder of the security alert phase and preventing user control of the corresponding elevator for the remainder of the security alert phase.

15. A method of securing an elevator access area, the method comprising:

defining a secure area including an elevator landing providing access to an elevator system including at least one elevator car;

monitoring the presence or entry of unauthorized individuals in the secure area;

initiating a security alert phase upon detecting the presence or entry of one or more unauthorized individuals in the secure area;

monitoring a status of each elevator car in the elevator system during the security alert phase to identify each elevator car having a respective door at the landing with an open door status; and for each elevator car that arrives at the landing during the security alert phase, allowing the corresponding door to fully open, subsequently holding the corresponding door open for the remainder of the security alert phase and preventing user control of the corresponding elevator for the remainder of the security alert phase.

16. The method of claim 13, wherein monitoring the presence or entry of unauthorized individuals in the secure area includes detecting the entrance of individuals through a protected entrance using a direction detector and wherein initiating the security alert phase includes triggering a breach signal if the direction detector detects an individual entering the secure area through the protected entrance without a previous authorized identification by an identification detector, and not triggering a breach signal if the direction detector detects an individual exiting the secure area through the protected entrance or if the identification detector detects an authorized identification before the direction detector detects an individual entering the secure area through the protected entrance.

17. The method of claim 13, further comprising ending the security alert phase.

18. An elevator installation comprising:

an elevator car, the elevator car comprising an elevator car entrance;

a monitoring device, the monitoring device comprising a card reader or a biometric reader, the monitoring device being configured to produce an alarm signal upon detecting a non-authorized individual within an area outside of and around the elevator car entrance; and an elevator controller, the elevator controller comprising a processor, wherein for each elevator car having a door at the landing that is opening at the beginning of the security alert phase, closing at the beginning of the security alert phase and subsequently reopening, or arriving at the landing during the security alert phase, the elevator controller is configured to determine that a door of the elevator car is at least partly open and prevent use of the elevator car in response to the alarm signal.

19. One or more computer-readable storage media having encoded thereon instructions that, when executed by a processor, cause the processor to perform a method, the method comprising:

monitoring an area for unauthorized individuals, the area comprising at least part of an elevator landing;

initiating an alarm period as a result of detecting at least one unauthorized individual entering the area or in the area;

for each elevator car having a door at the landing that is opening at the beginning of the security alert phase, closing and subsequently reopening at the beginning of the security alert phase, or arriving at the landing during the security alert phase, determining that an elevator car at the landing has a door that is at least partially open, preventing user operation of the elevator car during the alarm period and preventing closing of the elevator car door during the alarm period.

20. The method of claim 14, wherein monitoring the presence or entry of unauthorized individuals in the secure area includes detecting the entrance of individuals through a protected entrance using a direction detector and wherein initiating the security alert phase includes triggering a breach signal if the direction detector detects an individual entering the secure area through the protected entrance without a previous authorized identification by an identification detector, and not triggering a breach signal if the direction detector detects an individual exiting the secure area through the protected entrance or if the identification detector detects an authorized identification before the direction detector detects an individual entering the secure area through the protected entrance.

21. The method of claim 14, further comprising ending the security alert phase.

22. The method of claim 15, wherein monitoring the presence or entry of unauthorized individuals in the secure area includes detecting the entrance of individuals through a protected entrance using a direction detector and wherein initiating the security alert phase includes triggering a breach signal if the direction detector detects an individual entering the secure area through the protected entrance without a previous authorized identification by an identification detector, and not triggering a breach signal if the direction detector detects an individual exiting the secure area through the protected entrance or if the identification detector detects an authorized identification before the direction detector detects an individual entering the secure area through the protected entrance.

23. The method of claim 15, further comprising ending the security alert phase.

* * * * *